United States Patent [19]

Klinger et al.

[11] Patent Number: 4,586,470

[45] Date of Patent: May 6, 1986

[54] CENTRIFUGAL SPEED GOVERNOR FOR FUEL-INJECTED INTERNAL COMBUSTION ENGINES

[75] Inventors: Horst Klinger, Ludwigsburg; Werner Lehmann, Gerlingen; Michael Zeuch, Bietigheim, all of Fed. Rep. of Germany

[73] Assignee: Robert Bosch GmbH, Stuttgart, Fed. Rep. of Germany

[21] Appl. No.: 723,777

[22] Filed: Apr. 16, 1985

[30] Foreign Application Priority Data

Apr. 19, 1984 [DE] Fed. Rep. of Germany ..... 3414846

[51] Int. Cl.[4] ..... F02D 31/00

[52] U.S. Cl. ..... 123/367; 123/374

[58] Field of Search ..... 123/367, 374, 364–366, 123/368–373

[56] References Cited

U.S. PATENT DOCUMENTS

| | | | |
|---|---|---|---|
| 3,530,845 | 9/1970 | Staudt et al. | 123/374 |
| 3,903,860 | 9/1975 | Maier | 123/374 |
| 4,164,925 | 8/1979 | Maier et al. | 123/374 |
| 4,305,362 | 12/1981 | Schwartz et al. | 123/367 |

FOREIGN PATENT DOCUMENTS 175746 8/1953 Austria .

OTHER PUBLICATIONS

"Fuel Injection Equipment for Diesel Engines (2) Governors for In-Line Pumps", (VDT-UBP 210/1B, 1st ed., Sep. 30, 1975, FIG. 84 on p. 37.

*Primary Examiner*—Magdalen Y. C. Moy
*Attorney, Agent, or Firm*—Edwin E. Greigg

[57] ABSTRACT

A centrifugal speed governor, functioning as a minimum-maximum-speed governor, includes an adjusting member which is pivotable for adjusting the supply quantity, and the governor rod of the associated injection pump is adjustable via an intermediate lever by means of the adjusting member and a governor spring which is displaceable counter to the force of associated governor springs. The travel of the governor rod is limited in the direction of an increasing supply quantity by a governor rod stop including a starting spring. With the adjusting member resting on an end stop, the governor rod is pressed away from a basic test position (P) into its full-load position (V), and the differential travel (ΔR) thereby resulting is absorbed by an accumulator in the governor linkage, preferably in the governor sleeve. The deflection stroke (A) of the accumulator is only slightly longer than that required to compensate for the differential travel (ΔR). As a result, with the governor off the idling spring, with the accumulator blocked, can positively press the starting spring in the governor rod stop. Thus it is possible, in minimum-maximum-speed governors, to control a constant full-load position.

8 Claims, 3 Drawing Figures

CENTRIFUGAL SPEED GOVERNOR FOR FUEL-INJECTED INTERNAL COMBUSTION ENGINES

BACKGROUND OF THE INVENTION

The invention is based on a centrifugal speed governor for fuel-injected internal combustion engines as generally defined hereinafter. A centrifugal governor of this kind for fuel-injected internal combustion engines is already known from Austrian Pat. No. 175746; this governor operates as as a minimum-maximum-speed governor, and the travel of the governor rod in the direction of an increasing supply quantity is limited by a resiliently yielding governor rod stop including a starting spring. This stop functions as an automatic starting quantity stop. It is also known as a "resilient governor rod stop for RQ governors for limiting the starting quantity" in the publication by Robert Bosch GmbH, Stuttgart, Federal Republic of Germany entitled *Diesel Injection Equipment* (2): *Speed Governors for In-Line Injection Pumps* (VDT-UBP 210/1, 1st ed., Sept. 30, 1975, FIG. 84 on page 37). In these governors, when the governor stops and the adjusting member is resting on the end stop, the starting spring of the governor rod stop is positively pressed by the force exerted by the idling springs, and the governor rod assumes its starting position. As soon as the engine is running, after being started, the force of the flyweights and the starting spring retract the governor rod to at least shortly before its full-load position, thereby preventing an excessive emission of smoke after the engine has started up. These minimum-maximum-speed governors, in contrast to variable speed governors of the RQV type, have a rigid governor sleeve with fixed attachment points for the flyweights and the intermediate lever. As a result, the full-load position cannot be limited by the governor rod stop, because it is defined by an appropriate adjustment of the end stop, attached to the housing, for the adjusting member. In these governors, any longitudinal movement of the governor sleeve, generated by the swing of the flyweights, by bearing play at connecting points, and by play in the camshaft bearings, has an effect on the governor rod, with a corresponding lever translation. The governor rod accordingly starts to vibrate. At the maximum rpm, so-called "premature governing" occurs, which leads to a reduction in fuel quantity and thus to power losses directly in the range of maximum power. Because of the goyernor rod vibration, also called "governor rod chattering", the full-load position of the governor rod is no longer accurately defined, so that either the allowable governor rod travel, and in the worst case the smoke limit with it, is exceeded, or else the maximum power cannot be attained, for instance at relatively low rpm or in a middle rpm range. In other words, an unintended adaptation (rpm-dependent correction of the supply quantity) takes place. Adjusting these governors is extremely costly and very difficult to master, and a further disadvantage is that compromises must be made in terms of power and the smoke limit.

In variable-speed governors, such as those of Robert Bosch Type RQV, these disadvantages do not arise if a full-load stop adjusted to a fixed position is used; however, this stop must be unlocked in order to make a starting position available, because in order to preselect rpm the governor sleeve is provided with an accumulator having a very long deflection stroke. The drag spring of the accumulator must be capable of being compressed by the adjusting member during rpm preselection, so that the governor rod stop must be mechanically locked in a full-load position. In order to prepare for starting, this locking mechanism is released while the governor is off by a lever arrangement actuated by the governor sleeve or is unlocked by an electromagnet. This device has already been used for minimum-maximum-speed governors as well; however, it is very expensive, it is difficult to adjust in terms of the starting unlocking, and furthermore, in particular operating states, such as while starting up under heavy loads, the starting quantity may be maintained for too long in full-load operation, causing excessive smoke emission.

OBJECT OF THE INVENTION

It is the object of the invention, in minimum-maximum-speed governors of the generic type discussed herein and which are provided with a resiliently yielding governor rod stop, to eliminate unintended governor rod movements in full-load operation which cause a decrease in power or excessive smoke emission, or which make it more difficult to effect the basic setting of the governor.

SUMMARY OF THE INVENTION

In the centrifugal governor according to the invention which functions as a minimum-maximum-speed governor, it is possible to fix the full-load position of the governor rod by means of the resiliently yielding governor rod stop and at the same time to select an increased starting quantity automatically while the governor is off, despite the adjusting member then resting on the end stop. The feared phenomenon of governor rod chatter and the resultant inaccuracies in controlling the supply quantity and difficulty in adjustment are thereby avoided. Because the deflection stroke of the accumulator disposed in the governor linkage is very short in comparison with known accumulators, allowing only slightly more than the difference in travel between the basic test position and the full-load position, the drag spring of the accumulator is ineffective whenever the starting spring of the resiliently yielding governor rod stop is positively pressed while the governor is off. Because of this very short deflection stroke, the still remaining portion of the idling stroke suffices to press the governor rod into the starting position. It is no longer possible, under any circumstances, to drive with an increased starting quantity after starting.

Advantageous further developments of and improvements to the centrifugal governor are attainable by means set forth herein. In a centrifugal governor of the generic type discussed above, in which in the resting position of the flyweights the restoring force of the idling spring overcomes the restoring force of the starting spring, which is reduced to the same point, for instance to the governor sleeve, it becomes possible to adjust the governor rod full-load position by tuning the springs, without affecting the governor function. According to a further feature of the invention, the accumulator is particularly advantageously built into the bearing bolt, and the dimension of the deflection stroke A can be fixed directly by how the transverse bore in the bearing bolt is shaped. To this end, it is for instance possible to drill the transverse bore, which is already present in the bearing bolt, to a wider diameter which however is increased merely by the dimension of the deflection stroke, thereby making the costly provision of an oblong slot unnecessary.

If the centrifugal governor according to the invention is one having an adaptation device, then once again the full-load position which controls the maximum possible supply quantity can be set by means of the governor rod stop, if the governor is designed in accordance with a further provision of the invention. To this end, the adaptation control stroke is set to be longer, by an amount corresponding to the differential travel at the governor rod, than the adaptation control stroke otherwise required in the known governors. This has the very great advantage that in the case of short adaptation travel, the adaptation control stroke of the flyweights or of the governor sleeve, which otherwise is still shorter because of the translation of the intermediate lever, can be adjusted to a dimension, such as 0.2 mm, which is still readily attainable regardless of the adaptation travel required. The resultant adaptation travel of 0.4 mm can then, however, be reduced, for instance to 0.2 mm, in an infinitely variable manner by the governor rod stop. As a result, extremely short adaptation travel distances, which were absolutely impossible previously because of the existing tolerances for component parts, can be established with great accuracy. Furthermore, different adaptation travel distances can be established at the same basic setting, without having to change the basic setting. This last feature is particularly advantageous in engines manufactured in series, which are adjusted to a varyingly high output only before being delivered to the customer.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
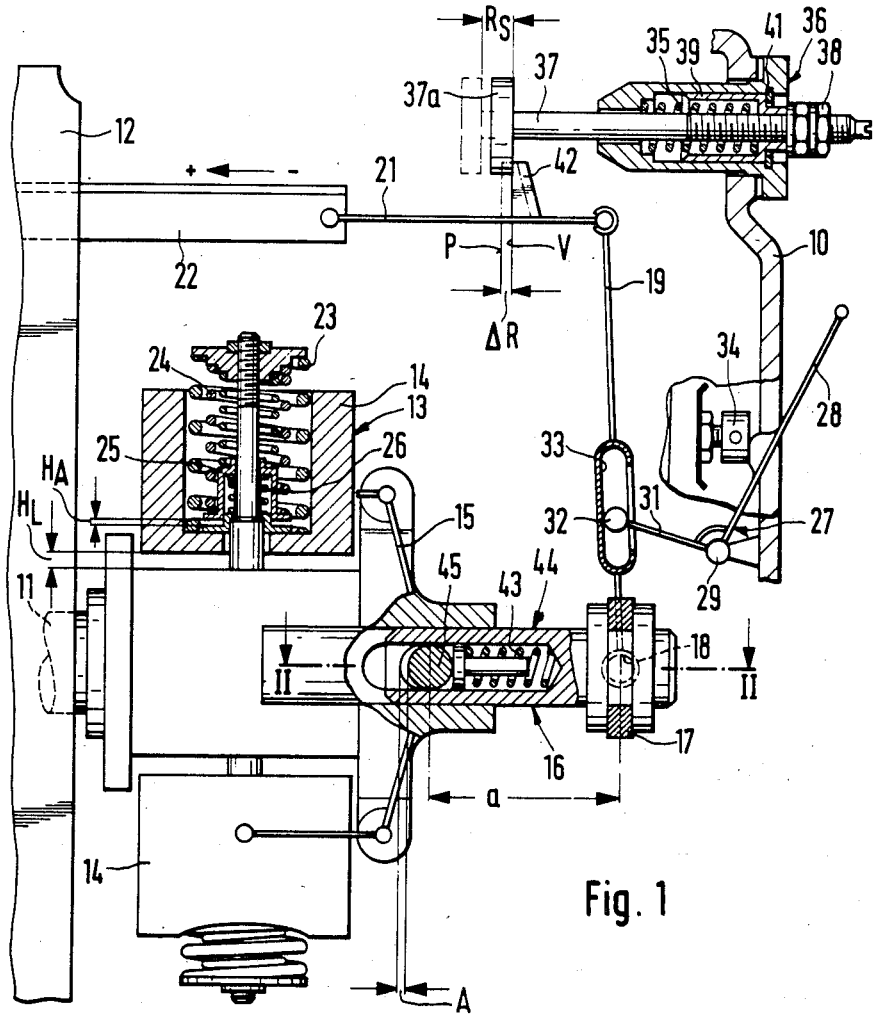
FIG. 1 is a simplified illustration of the exemplary embodiment of the invention, which operates as a minimum-maximum-speed governor, in cross section.

The centrifugal governor shown in simplified form in FIG. 1 is a minimum-maximum-speed governor, Robert Bosch Type RQ. In a housing 10, this governor has a centrifugal governor 13 secured on the camshaft 11 of an injection pump, which is embodied as an in-line injection pump known per se and is therefore shown only fragmentarily. The centrifugal governor 13 has two flyweights 14, which under centrifugal force and counter to the force of governor springs transmits a movable force via bell cranks 15 to a governor sleeve 16. Coupled with the governor sleeve 16 via a sliding block 17 and its bearing trunnion 18 is an intermediate lever 19, which is embodied as a two-armed lever and is articulatedly joined to a governor rod 22 of the injection pump 12 via a connecting strap 21.

The centrifugal governor 13 is of a known type and includes governor springs and spring plates such as those typically included in a Robert Bosch centrifugal speed governor, type RQ, with adaptation capability. Each of the flyweights 14 includes one idling spring 23, at least one maximum-speed governor spring 24 and, one adaptation spring 26 accommodated in an adaptation capsule 25.

The intermediate lever 19 is actuatable by means of an adjusting member 27, which is pivotable in order to adjust the supply quantity. The adjusting member 27 comprises an external adjusting lever 28, which is actuatable by a person operating the apparatus, and a steering lever 31 joined in a rotationally fixed manner to the adjusting lever 28 via a lever shaft 29. By means of a tang 32, one end of the steering lever 31 engages a slot guide 33 of the intermediate lever 19 and as its pivoted position varies it also varies the translation ratio of the two lever arms of the intermediate lever 19. As shown in FIG. 1, in its maximally pivoted position, which allows the maximum possible supply quantity to be set, the adjusting lever 28 rests on an adjustable end stop 34 attached to the housing.

The travel of the governor rod 22 in the direction of an increasing supply quantity in the direction of the arrow above it, marked + and −, is limited by a resiliently yielding governor rod stop 36 including a starting spring 35 via stop nose 42 secured to rod 21. The governor rod stop 36 functions as an automatic increased starting quantity stop and when the governor is off, as will be discussed below, it makes available a starting travel $R_S$ which allows an increased starting quantity. The governor rod stop 36 includes a stop bolt 37 located with its longitudinal axis parallel to the longitudinal axis of the governor rod 22. The stop bolt 37 is supported via two lock nuts 38 on a guide sleeve 39 which is subject to the prestressing force of the starting spring 35. The outset position of the guide sleeve 39 is fixed in turn by a snap ring 41. In the position of the stop bolt 37 shown, this element, with a head 37*a*, embodies a limiting stop for a counterstop joined to the governor rod 22, the counterstop being embodied by a stop nose 42 disposed on the connecting strap 21. By means of the stop nose 42, the governor rod stop 36 has pressed the governor rod 22 out of a basic test position P, located above the full-load position V and indicated by dot-dash lines, into the full-load position V by the length of a differential travel ΔR. To make this possible, the governor sleeve 16 is equipped with a travel or force accumulator 44, which serves as a deflection member and includes a drag spring 43.

Figure 2:
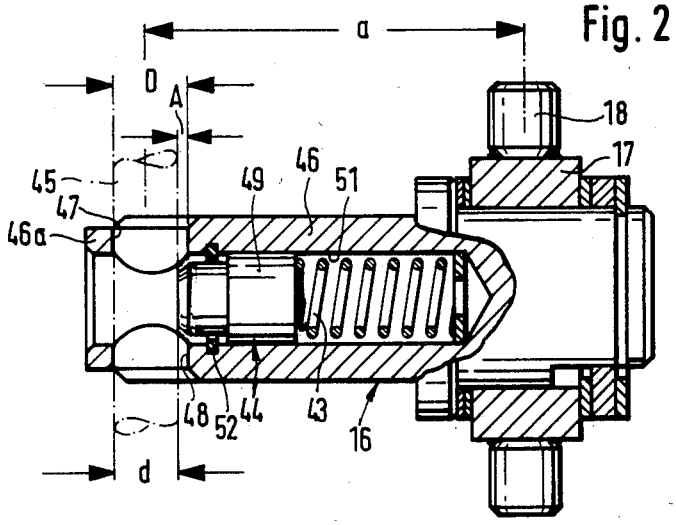
FIG. 2 is a section through the governor sleeve, taken along the line II—II of FIG. 1, on an enlarged scale.

The governor sleeve 16 provided with the accumulator 44 is shown in simplified form in FIG. 1; in contrast, FIG. 2 shows a practical embodiment of such a governor sleeve 16 on an enlarged scale, in a sectional view taken along the line II—II of FIG. 1. The governor sleeve 16 encompasses a bearing bolt 46, which on one end 46*a*, as the articulation point of the flyweights 14, carries a connecting bolt 45 inserted through a transverse bore 47 of the bearing bolt 46, and the articulation point of the intermediate lever 19 is embodied by the bearing trunnion 18 located on the sliding block 17. The distance between the two articulation points, that is, between the connecting bolt 45 and the bearing trunnion 18, indicated by the letter a (see FIG. 2), and this distance is shown in FIG. 1 having been shortened by the length of a deflection stroke A. The distance a has been shortened by this deflection stroke A because the governor rod stop 36 has pressed the governor rod 22 away by the length of the differential travel ΔR. In this process, the accumulator 44 of the governor sleeve 16 is tensed via the intermediate lever 19, with the adjusting lever 28 resting on the end stop 34. During this time, the flyweights 14 have maintained the position they assume after an idling stroke $H_L$ has been traversed. The maximum possible deflection stroke A of the accumulator 44 is limited by a stroke stop 48 and is only slightly longer than the differential travel ΔR at the governor rod 22, which travel is transmitted to the governor sleeve 16. To this end, the diameter D of the transverse bore 47 is larger, by the dimension of the deflection stroke A, than the diameter d of the connecting bolt 45, and the connecting bolt 45, in the outset position shown in FIG. 2 (maximum possible length of the distance a), is pressed against the outermost pointing wall end of the transverse bore 47, while the stroke stop 48 of the accumulator 44 is embodied by the opposite wall end of the transverse bore 47. The drag spring 43 is supported at one end, via a thrust bolt 49, which is forced against connecting bolt 45 and on the other end supported on the bottom of a blind bore 51 extending in the longitudinal direction of the bearing bolt 46. The blind bore 51 receives both the thrust bolt 49 and the drag spring 43. To prevent the loss of the thrust bolt 49 when the connecting bolt 45 is removed, a snap ring 52 is inserted into the wall of the blind bore 51. For satisfactory function of the governor, the restoring force of the idling spring 23, in the position of rest of the flyweights 14, must overcome the restoring force of the starting spring 35, which is reduced to the same point, for instance to the governor sleeve 16. Furthermore, the restoring force of the drag spring 43 must be less than the prestressing force, transmitted to the governor sleeve 16, of the starting spring 35, yet greater than the adjusting force of the governor which is required for adjusting the governor rod 22 and transmitted by the governor sleeve 16.

As will be described in further detail below in conjunction with FIG. 3, the mode of operation of the governor according to the invention can also be realized in speed governors which do not include any adaptation device, and hence do not include any adaptation springs 26. In the present governor, which controls an adaptation of the full-load supply quantity, the centrifugal governor 13 is designed to control not only the idling stroke $H_L$ but also an adaptation control stroke $H_A$, so that with increasing rpm, the flyweights 14, after the idling stroke $H_L$ has been traversed, traverse the correspondingly adjusted adaptation control stroke $H_A$ counter to the restoring force of the adaptation springs 26 and retract the governor rod 22, via the governor sleeve 16 and the intermediate lever 19, out of a maximum basic full-load setting into a reduced full-load setting $V_{red}$ by the length of an adaptation travel $R_{AV}$ that has been increased in accordance with the lever translation effective at the intermediate lever 19. In the centrifugal speed governor described, the maximum basic full-load position is now equal to the basic test position P of the governor rod 22 controlled by the adjusting member 27 resting on the end stop 34. The adaptation travel $R_A$ now actually controlled by the governor is shorter, by the amount of the differential travel ΔR, than would correspond to the adaptation control stroke $H_A$ controlled by the adaptation spring 26. In other words, the adaptation control stroke $H_A$ controlled by the adaptation spring 26 can be set at a length which is longer, by an amount corresponding to the differential travel ΔR at the governor rod 22, than the adaptation control stroke required for the actual adaptation travel $R_V$ covered by the governor rod 22 between the full-load position V and a reduced full-load position $V_{red}$. It is thus possible, by means of the arrangement according to the invention, to realize extremely short adaptation travel distances, which cannot be realized in known speed governors, not embodied according to the invention because of the effective lever translation at the intermediate lever 19 and because of the component part tolerances that must be taken into account.

Figure 3:
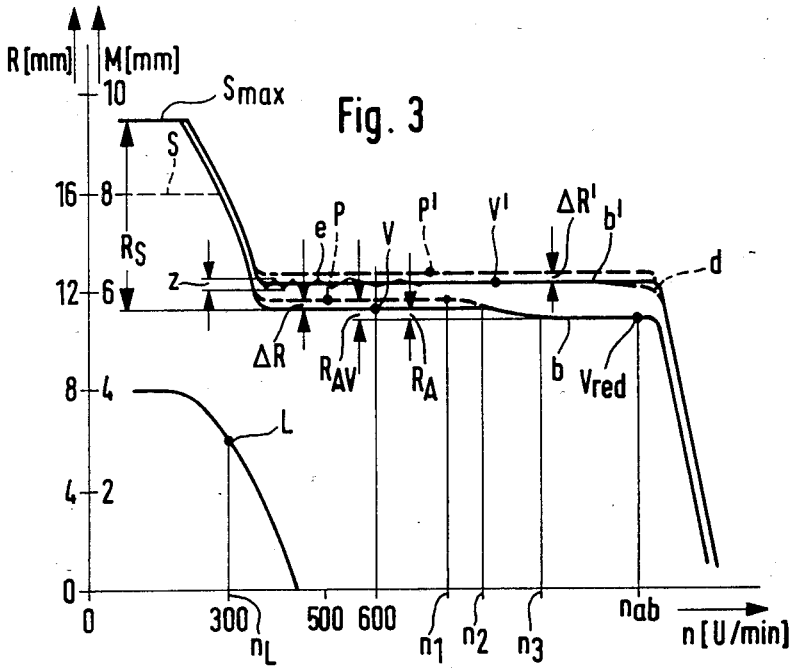
FIG. 3 is a diagram showing governor curves made possible by the invention.

The diagram of FIG. 3 serves to explain the function of the centrifugal speed governor shown in FIG. 1. The rpm n of the camshaft 11 is plotted on the abscissa, and the position, or governor travel R, of the governor rod 22 is plotted on the ordinate. A governor curve b shows the course of the governor travel R over the rpm for the minimum-maximum-speed governor shown in FIG. 1. A governor curve b' plotted at a higher level for the sake of clarity shows the corresponding course of the governor travel R over the rpm n for a minimum-maximum-speed governor not having an adaptation device. An idling governor curve c having the idling point L at the idling rpm $n_L = 300$ rpm is plotted on the diagram for the sake of completeness but is not significant for the purpose of the following observations. In addition to R, the sleeve travel M for a lever translation at the intermediate lever 19 of 1:2 is plotted on the ordinate.

The function of the centrifugal speed governor equipped in accordance with the invention will now be described, referring to FIGS. 1 and 3.

With the adjusting lever 28 of the adjusting member 27 resting on the end stop 34, and after the flyweights 14 have traversed the idling stroke $H_L$, the governor elements are located in the position shown in FIG. 1, at an rpm n of approximately 600. Via the stop nose 42 on the connecting strap 21, the governor rod stop 36 has pressed the governor rod 22 out of the basic test position P into the full-load position V by the amount of the differential travel ΔR. In this process, as the drag spring 43 has been compressed, the distance a between the articulation points 45 and 18 on the governor sleeve 16 has been shortened by the length of the deflection stroke A. The governor rod stop 36 thus retains the governor rod 22 firmly in its full-load position V and prevents movement of the governor rod 22, that is, "governor rod chattering", even if there should be any longitudinal play at the camshaft 11 and corresponding play at the articulation points. Now if the rpm continues to increase, then the flyweights 14, at rpm n1, begin to move outward, counter to the restoring force of the adaptation springs 26, thereby shortening the adaptation control stroke $H_A$. The position of the governor rod 22 does not vary, however, until at n2 the flyweights 14 or the governor sleeve 16 have traversed the differential travel ΔR and the governor sleeve 16 has relaxed by the portion of the deflection stroke A by which it was previously pressed away. The articulation points 45 and 18 on the governor sleeve 16 now assume their maximum possible distance a from one another, as shown in FIG. 2. Now the governor sleeve 16 functions like a rigid connecting member, and as the rpm continues to increase the governor rod 22 is retracted from the full-load position V into the reduced full-load position $V_{red}$. This reduced full-load position is maintained by the governor rod 22 above the rpm n3 until the breakaway rpm $n_{ab}$ is reached. Breakaway regulation and idling regulation take place in the usual manner and will therefore not be described here in further detail.

If the engine is to be started from a state of being shut off, then the operator will pivot the adjusting lever 28 into the full-load position shown, in which it rests on the end stop 34. Under the influence of the force of the idling springs 23, the flyweights 14 are pressed out of the position shown and, overcoming the idling stroke $H_L$, into their inner position in the direction toward the axial center of the camshaft 11. On account of the low prestressing force of the drag spring 43, the spacing or distance a of the governor sleeve 16 is shortened by the effective dimension of the deflection stroke A, and on account of the deflection stroke A, which as a rule is shorter than 1 mm, the remaining portion of the idling stroke $H_L$ suffices to displace the governor rod 22, by means of pivoting the intermediate lever 19 counterclockwise, out of the fullload position V into its maximum starting position, indicated as $S_{max}$ in FIG. 3, by the amount of the starting travel $R_S$. In this process, the starting spring 35 in the governor rod stop 36 is positively pressed by the corresponding amount. In the maximum starting position $S_{max}$, as a rule a so-called "starting groove" on the pumping element comes into effect, by means of which the increased starting quantity is controlled. If starting position S of for instance 16 mm in governor travel is desired at the engine, controlled by the oblique edge of the stop nose 42, then it is possible either to limit the starting travel $R_S$ of the governor rod 22 on the front end of the pump by means of a known, fixed stop (not shown), or to fix this travel by means of the length of the guide sleeve 39. The abovementioned starting position S is shown in the diagram of FIG. 3 with dashed lines. From this diagram it is apparent that approximately at an rpm $n_L=300$ rpm, this starting position S is retracted to the full-load position V, with the governor curve b. In this process, both the idling springs 23 and the starting spring 35 come into effect.

If the centrifugal speed governor is not equipped with an adaptation device, then the adaptation springs 26 and adaptation capsules 25 are lacking. This governor operates according to the governor curve b'. The governor rod 22 has been pressed by the governor rod stop 36 out of the basic test position P' into the full-load position V', which is held precisely constant in the entire unregulated range above the idling rpm $n_L$ and the breakaway rpm $n_{ab}$. In the known minimum-maximum-speed governors, in which the end stop 34 of the adjusting member 27 directly determines the full-load position V, deviations from the exact full-load characteristic curve caused by vibration movements of the governor elements and by play at the articulation points; these deviations are exhibited in the form of governor rod chattering, especially in the lower and medium rpm range. The chattering movements thereby occurring have been plotted with a roughly simplified zigzag line e in the lower rpm range, superimposed on the governor curve b', and the amplitude of these movements is marked z. Shortly before the breakaway rpm $n_{ab}$, a "premature regulation" takes place, as indicated by a portion of the curve d drawn in dashed lines. This phenomenon makes it more difficult to set both the breakaway rpm $n_{ab}$ and the associated full-load point $v_{red}$. Both problems are avoided, in the above-described speed governor, by adjusting the governor rod stop 36 in accordance with the invention. Even an "unintended adaptation" that would otherwise be generated by a longitudinal movement of the camshaft 11 is no longer possible.

The resiliently yielding governor rod stop 36 can naturally be replaced by a starting stop (not shown) having the same functional effect and engaging the drive side end (not shown) of the governor rod 22. Also, instead of the two sets of springs (governor springs 23, 24 and 26) accommodated in the flyweights 14, a single set of springs acting centrally upon the governor sleeve 16 may instead be used in a known manner, without in any way changing the described mode of operation of the minimum-maximum-speed governor according to the invention. In like manner, the invention can also be realized with a minimum-maximum-speed governor in which the accumulator 44 is disposed not in the governor sleeve 16 but at some other point in the governor linkage located between the governor sleeve 16 and the engagement point (stop nose 42) of the governor rod stop 36, for instance on the sliding block 17, in the intermediate lever 19 or in the connecting strap 21. The realization which is the simplest to attain, as well as the most inexpensive, in terms of the spring forces, travel lengths and governor function is that in which the accumulator 44 is built inside the governor sleeve 16 as shown in the exemplary embodiment.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A centrifugal speed governor for fuel-injected internal combustion engines, which functions as a minimum-maximum-speed governor comprising:

a housing, a governor, said governor including a pair of flyweights and governor springs supported by said flyweights, said governor springs including at least one idling spring and at least one maximum-speed governor spring, a governor sleeve adapted to be displaceable by said flyweights in accordance with rpm counter to a force of the governor springs, said governor sleeve adapted to move a governor rod via an intermediate lever, which is actuatable by means of a pivotably adjusting member which is pivoted against an end stop attached to said housing for adjusting a supply quantity, said adjusting member when in its maximally pivoted position setting for a maximum possible supply quantity rests on said end stop, a resiliently yielding governor rod stop in which a movement of the governor rod in a direction of an increasing supply quantity is limited by said resiliently yielding governor rod stop, said governor rod stop includes a starting spring which restricts movement of said governor rod stop, said intermediate lever including a connecting strap which is secured to said governor rod, a counterstop secured to said connecting strap, said governor rod stop engaging said counterstop, end stop of the adjusting member is adjusted into a position which is associated with a basic test position (P; P') of the governor rod located above the full-load position (V;V') by a slight differential travel ($\Delta R$; $\Delta R'$), wherein this differential travel ($\Delta R$, $\Delta R'$) is fixed to an amount on the order of magnitude of a few tenths of a millimeter;

an accumulator located between an articulation point of said flyweights on said governor sleeve and said counterstop on said connecting strap joined to the governor rod, said accumulator includes a drag spring, the maximum possible deflection stroke (A) of the accumulator, enabling a shortening of its effective structural length by a distance a, being limited by a stroke stop in said accumulator and being only slightly longer than the differential travel ($\Delta R$; $\Delta R'$), of the governor rod; and the governor rod is pressed by means of said governor rod stop away from the basic test postion (P; P') into its full-load position (V; V') and retained there, as soon as and for as long as said adjusting member rests on the end stop and the governor sleeve maintains its position assumed after an idling stroke ($H_L$) has been traversed.

2. A centrifugal speed governor as defined by claim 1, in which a rest position of said flyweights, said idling spring exerts a restoring force which overcomes a restoring force on said governor sleeve exerted by said starting spring and a restoring force of a drag spring is less than a prestressing force of said starting spring, but is greater than an adjusting force of said governor required for adjusting said governor rod transmitted by the governor sleeve.

3. A centrifugal speed governor as defined by claim 1, in which the governor sleeve encompasses a bearing bolt, which at one end includes a connecting bolt embodying an articulation point of said flyweights, said connecting bolt passes through a transverse bore of the bearing bolt in which the diameter of said bore is greater than said connecting bolt, and the other end of said bearing bolt has an articulation point of said intermediate lever wherein said accumulator is included in said bearing bolt of the governor sleeve, said diameter of the transverse bore measured in the direction of the longitudinal axis of the bearing bolt is greater, by a dimension of a deflection stroke (A), than a diameter of the connecting bolt, and said bearing bolt is pressed by said drag spring against one wall end of said transverse bore, and that a stroke stop of the accumulator is embodied by the opposite wall end of the transverse bore.

4. A centrifugal speed governor as defined by claim 2, in which the governor sleeve emcompasses a bearing bolt, which at one end includes a connecting bolt embodying an articulation point of said flyweights, said connecting bolt passes through a transverse bore of the bearing bolt in which the diameter of said bore is greater than said connecting bolt, and the other end of said bearing bolt has an articulation point of said intermediate lever wherein said accumulator is included in said bearing bolt of the governor sleeve, said diameter of the transverse bore measured in the direction of the longitudinal axis of the bearing bolt is greater, by a dimension of a deflection stroke (A), than a diameter of the connecting bolt, and said bearing bolt is pressed by said drag spring against one wall end of said transverse bore, and that a stroke stop of the accumulator is embodied by the opposite wall end of the transverse bore.

5. A centrifugal speed governor as defined by claim 3, characterized in that said drag spring is supported at one end via a thrust bolt on the connecting bolt and at the other end on said bottom of a blind bore extending in the longitudinal direction of the bearing bolt, and said blind bore receives both the thrust bolt and said drag spring.

6. A centrifugal speed governor as defined by claim 4, characterized in that said drag spring is supported at one end via a thrust bolt on the connecting bolt and at the other end on said bottom of a blind bore extending in the longitudinal direction of the bearing bolt, and said blind bore receives both the thrust bolt and said drag spring.

7. A centrifugal speed governor as defined by claim 1, in which with increasing rpm said flyweights traverse an idling stroke ($H_L$), and a fixed adaptation control stroke ($H_A$) counter to a restoring force of at least one adaptation spring and via said governor sleeve and said intermediate lever retract said governor rod out of a maximal basic full-load position into a reduced full-load position ($V_{red}$), by an amount of an adaptation travel ($R_{AV}$) increased in accordance with a lever translation effective at said intermediate lever, in which a basic test position (P) of the governor rod controlled by said adjusting member resting on said end stop is adjusted to a maximal basic full-load position, and said governor rod is pressed by said governor rod stop away from the basic test position (P) into a required full-load position (V) by an amount of the differential travel ($\Delta R$), and that an adaptation control stroke ($H_A$) controlled by said adaptation spring is set to be greater, by an amount corresponding to the differential travel ($\Delta R$) at the governor rod, than the adaptation control stroke required for the adaptation travel ($R_A$) actually traversed by the governor rod between the full-load position (V) and a reduced full-load position ($V_{red}$).

8. A centrifugal speed governor as defined by claim 2, in which with increasing rpm said flyweights traverse an idling stroke ($H_L$), and a fixed adaptation control stroke ($H_A$) counter to a restoring force of at least one adaptation spring and via said governor sleeve and said intermediate lever retract said governor rod out of a maximal basic full-load position into a reduced full-load position ($V_{red}$), by an amount of an adaptation travel ($R_{AV}$) increased in accordance with a lever translation effective at said intermediate lever, in which a basic test position (P) of the governor controlled by said adjusting member resting on said end stop is adjusted to a maximal basic full-load position, and said governor rod is pressed by said governor rod stop away from the basic test position (P) into a required full-load position (V) by an amount of the differential travel ($\Delta R$), and that an adaptation control stroke ($H_A$) controlled by said adaptation spring is set to be greater, by an amount corresponding to the differential travel ($\Delta R$) at the governor rod, than the adaptation control stroke required for the adaptation travel ($R_A$) actually traversed by the governor rod between the full-load position (V) and a reduced full-load position ($V_{red}$).

* * * * *